United States Patent [19]

Höll et al.

[11] Patent Number: 4,759,290

[45] Date of Patent: Jul. 26, 1988

[54] DEVICE FOR CONTROLLING GRIPPERS IN SHEET-FED ROTARY PRESSES

[75] Inventors: Roland Höll, Weiterstadt; Dietrich Dettinger, Heusenstamm, both of Fed. Rep. of Germany

[73] Assignee: M.A.N.-Roland Druckmaschinen Aktiengesellschaft, Fed. Rep. of Germany

[21] Appl. No.: 838,159

[22] Filed: Mar. 10, 1986

[30] Foreign Application Priority Data

Mar. 12, 1985 [DE] Fed. Rep. of Germany ..... 3508697

[51] Int. Cl.[4] ..... B41F 1/30

[52] U.S. Cl. ..... 101/415.1; 101/409

[58] Field of Search ..... 101/409, 410, 415.1

[56] References Cited

U.S. PATENT DOCUMENTS

| | | | |
|---|---|---|---|
| 1,628,960 | 5/1927 | English et al. | 101/409 |
| 3,125,022 | 3/1964 | Reinartz et al. | 101/410 |
| 3,414,259 | 12/1968 | Koch et al. | 101/409 |
| 4,120,244 | 10/1978 | Wirz | 101/409 X |
| 4,133,263 | 1/1979 | Schilling | 101/409 |
| 4,210,079 | 7/1980 | Raes | 101/410 X |
| 4,402,266 | 9/1983 | Sugiyama | 101/409 |
| 4,475,459 | 10/1984 | Wanke et al. | 101/410 |

FOREIGN PATENT DOCUMENTS

| | | | |
|---|---|---|---|
| 676745 | 6/1939 | Fed. Rep. of Germany | 101/409 |
| 259597 | 2/1927 | United Kingdom | 101/409 |
| 272786 | 6/1927 | United Kingdom | 101/409 |

*Primary Examiner*—Edgar S. Burr
*Assistant Examiner*—Huong Q. Pham
*Attorney, Agent, or Firm*—Leydig, Voit & Mayer

[57] ABSTRACT

A device for controlling the opening of a plurality of sheet grippers in a sheet-fed rotary press wherein the grippers are arranged to form a row on a gripper shaft disposed on a rotating cylinder. The gripper shaft is centrally controlled between its ends by two cam control systems acting in parallel relationship on the ends of an actuating shaft, by turning of the latter, with a central adjusting means interconnecting the actuating shaft and the gripper shaft to provide a symmetrically divided torsional force adjustable to vary the opening width of the grippers according to the sheet thickness being processed.

1 Claim, 2 Drawing Sheets

DEVICE FOR CONTROLLING GRIPPERS IN SHEET-FED ROTARY PRESSES

FIELD OF THE INVENTION

The present invention relates generally to a device for controlling grippers in sheet-fed rotary presses and more particularly concerns such a device wherein the grippers are arranged to form a row on a gripper shaft disposed on a rotating cylinder and the device includes means for adjusting the opening width of the grippers.

BACKGROUND OF THE INVENTION

Prior patents DE-AS No. 2,126,258 and DE-AS No. 2,613,174 disclose devices for controlling grippers in sheet-fed rotary presses of the kind referred to above, wherein only one drive is provided to control the gripper shaft. If considerable gripper forces are applied, the system comprising the gripper control cam, cam follower, drive lever, gripper shaft and adjustment means may be distorted on closing due to overloading of the considerably pre-stressed grippers, so that the closing operation is delayed and the power build-up lengthened. As a result, even at high speeds the impact force of the grippers does not go beyond the static retaining force such that blurring results with considerable distortion of the system.

DE-PS No. 834,107 discloses a device for controlling grippers in sheet-fed rotary presses having two drives disposed in parallel relationship and jointly turning a torsion spring to produce an identical or a different stress condition, the drives being disposed on each side of an impression cylinder. This device relates to a pre-gripper control system and not the control of grippers of the rotating cylinder. However, it is not possible to adjust the gripper opening width, so that register differences occur.

The primary aim of the present invention is to enable power built up to close the grippers to be introduced symmetrically from a central point on the gripper shaft with the required accuracy via two parallel drives so as to be adjustable to different printing materials, in order to obviate register differences and blurring.

According to the invention the grippers are arranged in a row on the gripper shaft disposed on a rotating cylinder. The gripper shaft is centrally controlled between its ends by two cam control systems acting in parallel relationship on the ends of an actuating shaft, by turning of the latter, with a central adjusting means interconnecting the actuating shaft and the gripper shaft to provide a symmetrically divided torsional force adjustable to vary the opening width of the grippers according to the sheet thickness being processed. The actuating and gripper shafts may be disposed in spaced apart parallel relation or concentric to one another.

The advantages of the invention are that faster gripper closure and shortened power build-up are obtained, because distortion of the system comprising the gripper control cam, drive lever, cam follower, actuating shaft, gripper shaft and adjustment means is reduced despite increased gripper forces. The power is introduced centrally and symmetrically to both cam control systems so as to be adjustable to different printing materials, so that register differences and blurring are obviated.

These and other features and advantages of the invention will be more readily apparent upon reading the following description of the preferred embodiments of the invention and upon reference to the accompanying drawings wherein.

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENTS

Figure 1:
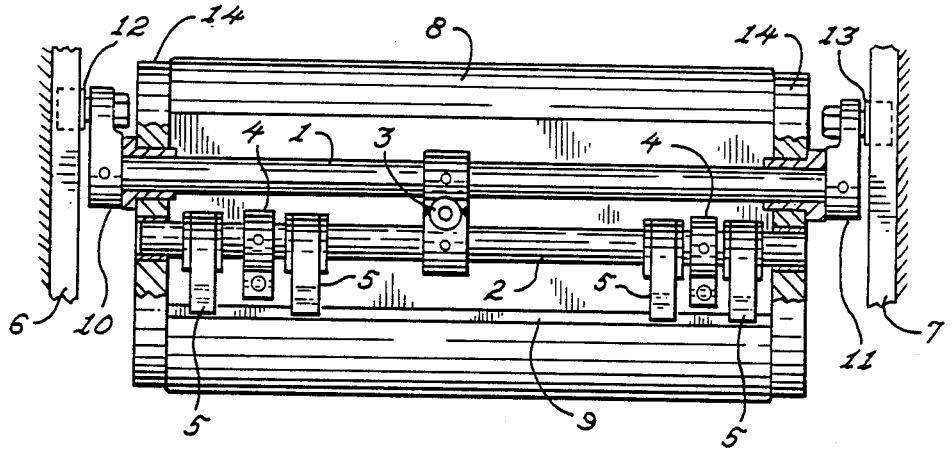
FIG. 1 is a plan view, partly in section, of a gripper control device according to the invention, the control being by way of an actuating shaft spaced apart from the gripper shaft and disposed on a rotating cylinder.
Figure 2:
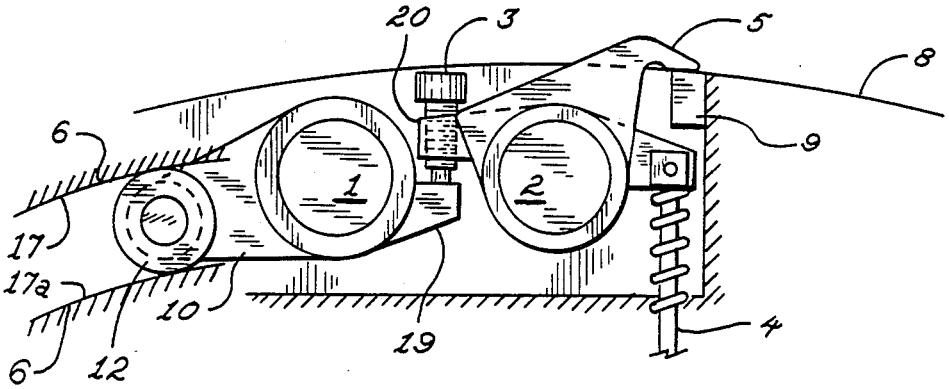
FIG. 2 is an enlarged, fragmentary and somewhat schematic side elevation of FIG. 1.
Figure 3:
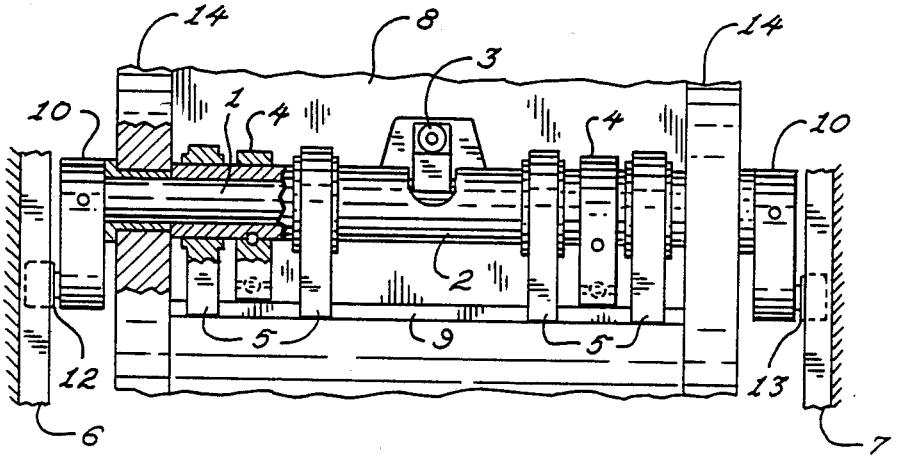
FIG. 3 is a plan view, similar to FIG. 1 of an alternative device according to the invention, wherein the control is arranged via an actuating shaft surrounded concentrically by the gripper shaft.

Turning now to the drawings, there is shown a portion of a sheet-fed printing press including a drum or impression cylinder 8 with which the gripper control arrangement of the present invention is associated. In order to simplify the description, like parts in FIGS. 1 to 5 have, where possible, been given like reference numbers. As shown in FIGS. 1 and 2, a number of grippers 5 are arranged in a row disposed on the rotating impression cylinder 8. The grippers 5 cooperate with a gripper support 9 carried by the cylinder 8 and the grippers are controlled via a drive comprising, on either side of the impression cylinder 8, a cam control system 6, 7 with respective drive levers 10, 11 and cam followers 12, 13.

Figure 4:
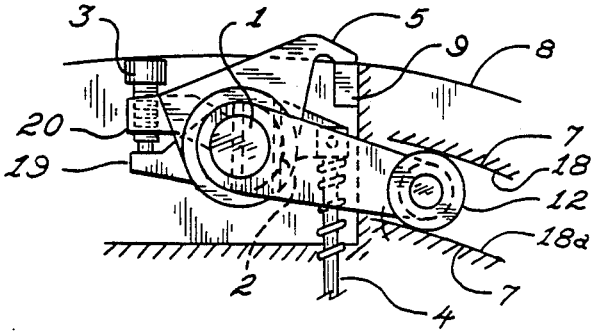
FIG. 4 is a somewhat schematic side elevation of FIG. 3.
Figure 5:
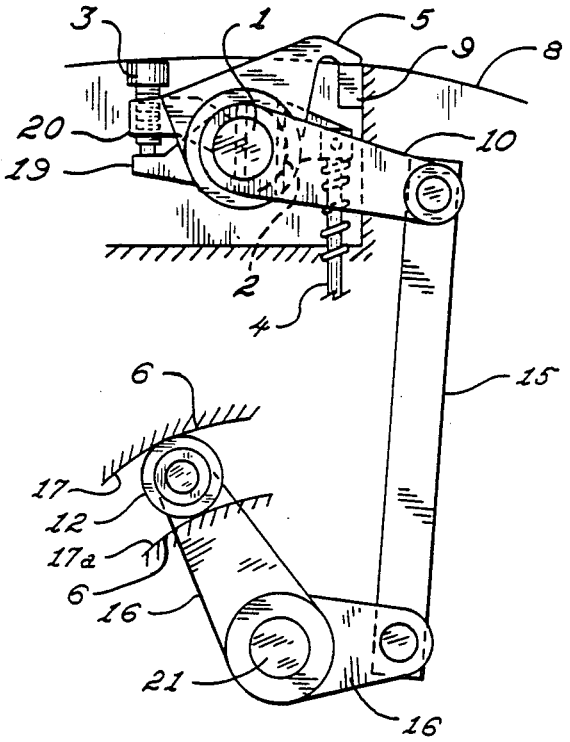
FIG. 5 is a side elevation of another embodiment of the device according to the invention wherein the control is arranged through the impression cylinder center.

Pursuant to the invention, a gripper shaft 2 which carries the grippers 5 in a row is actuated by an actuating shaft 1 via a central adjustment means 3, preferably including an adjusting screw with a scale. In the illustrated embodiment, the ends of both the actuating shaft 1 and the gripper shaft 2 are mounted for relative rotation in a gauge ring 14 secured to the ends of the cylinder 8 and the actuating shaft 1 is positively connected at its ends to the cam control levers 10, 11. As shown in FIGS. 2, 4 and 5, the grippers 5 are opened with respect to the support 9 by spring based rods 4.

The cam followers 12, 13 run around the periphery of the associated cam faces 17, 18, on the respective cams 6, 7. The cams 6, 7, preferably have identical curves and, for positive control, may have both internal faces 17, 18 and external faces **17*a*, 18*a* (see FIGS. 2 and 4). The power from the two drives is transmitted by the actuating shaft 1 through a central adjustment means 3 secured in the middle of the gripper shaft 2. For this purpose, the actuating shaft 1 has a centrally disposed arm 19 which bears against an adjusting screw 3 mounted in a central arm 20 of the gripper shaft 2 in order to provide a symmetrical drive connection and central adjustment to vary the gripper opening width according to the sheet thickness being processed. The arm 20 with the adjusting screw 3 is biased against the actuating arm 19 by the spring biased rods 4**.

By virtue of the central arrangement between the cam control systems 6, 7 on the one hand, and the actuating shaft 1 and the gripper shaft 2, on the other hand, the torsional force is symmetrically divided up and at the same time adjustable with the required accuracy to different sheet thicknesses. In this way, blurring and register differences are avoided because the system comprising the gripper control cams 6, 7, the drive levers 10, 11, cam followers 12, 13, actuating shaft 1, gripper shaft 2, and central adjustment means 3, is no longer inadmissibly stressed, owing to the parallel arrangement of two cam control systems 6, 7, despite the increased impact force of the grippers. The inclusion of the central adjustment means 3 also provides the necessary accuracy of adjustment of the gripper opening width to different printing materials uniformly from a central point to both drives.

In the illustrated embodiments, the actuating shaft 1 is formed as a rigid torsion spring in order to compensate any manufacturing errors in the cam faces 17, 18. As shown in FIGS. 1 and 2, the grippers 5 can be controlled by an actuating shaft 1 which is separate from the gripper shaft 2, the shafts being mounted for rotation in spaced apart, parallel relation to one another in the rotating impression cylinder 8 or a drum. According to another embodiment shown in FIGS. 3 and 4, the grippers 5 can be controlled by way of an actuating shaft 1 concentrically enclosed by a tubular gripper shaft 2. Finally, according to the embodiment shown in FIG. 5, the grippers 5 can be controlled by way of a lever drive 15, 16, pivotally supported on a shaft 21 concentric with the axis of the cylinder 8.

The position of the gripper shaft 2 in all the embodiments shown in FIGS. 1 to 5 is in each case selected according to the geometry of the gripper 5, while the position of the actuating shaft 1 is determined according to the optimum position for the control cams 17, 18 or the transmission parts 10, 11, 12, 13, 15, 16. The specific contour of the cam faces 17, 18 is, in part, dependent on the choice of the lever length of the drive levers 10, 11.

We claim as our invention:

1. A device for controlling the opening of a plurality of sheet grippers in a sheet-fed rotary press wherein the grippers are arranged in a row on a gripper shaft disposed on a rotating cylinder, the gripper opening being controlled via the gripper shaft, an actuating shaft, a drive lever carrying a cam follower and a cam control system and the device comprising means for adjusting the opening width of the grippers, characterized in that said gripper shaft is tubular and is disposed concentrically on the actuating shaft, said gripper shaft is controlled centrally between its ends by means of two cam control systems acting in parallel relationship on the ends of the actuating shaft to turn the latter and by a central adjusting means having one arm connected to the actuating shaft and another arm connected to the gripper shaft interconnecting the actuating shaft and the gripper shaft to provide a symmetrically divided torsional force on the gripper shaft adjustable to vary the opening of the gripper according to the sheet thickness being processed.

* * * * *